US010780595B2

(12) United States Patent
Lin et al.

(10) Patent No.: US 10,780,595 B2
(45) Date of Patent: Sep. 22, 2020

(54) MATRIX BEARD-LEAKING RAZOR HEAD

(71) Applicant: Ningbo Kaili Holding Group Co., Ltd, Ningbo, Zhejiang Province (CN)

(72) Inventors: Jian Lin, Ningbo (CN); Xiamin Hu, Ningbo (CN); Zongyue Chen, Ningbo (CN)

(73) Assignee: NINGBO KAILI HOLDING GROUP CO., LTD, Ningbo (CN)

( * ) Notice: Subject to any disclaimer, the term of this patent is extended or adjusted under 35 U.S.C. 154(b) by 0 days.

(21) Appl. No.: 16/057,214

(22) Filed: Aug. 7, 2018

(65) Prior Publication Data

US 2019/0061184 A1 Feb. 28, 2019

(30) Foreign Application Priority Data

| | | |
|---|---|---|
| Aug. 25, 2017 | (CN) | 2017 2 1075020 U |
| Dec. 12, 2017 | (CN) | 2017 1 1320358 |
| Dec. 12, 2017 | (CN) | 2017 2 1724595 U |
| Feb. 8, 2018 | (CN) | 2018 1 0128539 |
| Feb. 8, 2018 | (CN) | 2018 2 0223727 U |

(51) Int. Cl.

| | |
|---|---|
| ***B26B 21/40*** | (2006.01) |
| ***B26B 21/44*** | (2006.01) |
| ***B26B 21/56*** | (2006.01) |
| ***B26B 21/22*** | (2006.01) |

(52) U.S. Cl.

CPC ..... *B26B 21/4031* (2013.01); *B26B 21/22* (2013.01); *B26B 21/4068* (2013.01); *B26B 21/443* (2013.01); *B26B 21/565* (2013.01)

(58) Field of Classification Search

CPC ... B26B 12/4068; B26B 2/565; B26B 21/443; B26B 1/4031; B26B 21/22; B26B 2/222; B26B 21/40; B26B 21/227; B26B 21/4025; B26B 21/4018; B26B 21/565; B26B 21/4012; B21D 53/645

USPC ..... 30/20, 346.57, 50, 346.5, 41, 34.2, 77, 30/34.05

See application file for complete search history.

(56) References Cited

U.S. PATENT DOCUMENTS

| | | | | |
|---|---|---|---|---|
| 8,117,753 | B2 * | 2/2012 | Gilder | B26B 21/22 30/50 |
| 9,415,522 | B2 * | 8/2016 | Oglesby | B26B 21/4031 |
| 2004/0221455 | A1 * | 11/2004 | Coffin | B26B 21/222 30/50 |
| 2005/0198837 | A1 * | 9/2005 | Rawle | B26B 21/222 30/346.57 |
| 2013/0185942 | A1 * | 7/2013 | Van Eibergen Santhagens | B21D 53/645 30/50 |
| 2014/0026424 | A1 * | 1/2014 | Oglesby | B26B 21/4031 30/50 |

* cited by examiner

*Primary Examiner* — Ghassem Alie

(74) *Attorney, Agent, or Firm* — Charles C. Achkar; Ostrolenk Faber LLP.

(57) ABSTRACT

A matrix beard-trimmings guiding razor head includes a blade holder (1) and two or more blade assemblies (2) disposed on the blade holder (1) and arranged parallel to one another. Each blade assembly (2) has two or more layers of blades arranged in parallel. An assembly interval is arranged between two adjacent blade assemblies (2), and the assembly interval has a width of 0.2~5 mm. A layer interval is arranged between two adjacent layers of blades in each group of blade, and the layer interval has a width of 0.15~1.5 mm.

6 Claims, 37 Drawing Sheets

MATRIX BEARD-LEAKING RAZOR HEAD

CROSS REFERENCE TO RELATED APPLICATIONS

The present application claims priority to Chinese Application No. 201721075020.0, filed on Aug. 25, 2017, Chinese Application No. 201711320358.2 filed Dec. 12, 2017, Chinese Application No. 201721724595.0 filed Dec. 12, 2017, Chinese Application No. 201810128539.3 filed Feb. 8, 2018, and Chinese Application No. 201820223727.X filed Feb. 8, 2018, the subject matter of each of which are incorporated herein by reference in their entirety.

FIELD OF INVENTION

The present disclosure relates to the field of shaving devices, in particular to a matrix beard-trimmings guiding razor head.

BACKGROUND OF INVENTION

1. Description of the Related Art

According to structure, shavers are mainly divided into three types: safety razors, electric shavers, and mechanical shaver. The safety razor is primarily comprised of a blade and a hoe-shaped blade holder. The blade holder is made of aluminum, stainless steel, copper or plastic, etc., and the blade is made of stainless steel, or carbon steel. To have a sharp and durable shaver, the blade is generally processed with a metal or chemical coating. During use, the blade is mounted onto the blade holder, so that users may hold the handle of the blade holder to shave. There are two blade mount structures available in the market as shown in FIGS. 1 and 2. In general, the blade holder has a plurality of evenly distributed gaps. Since the gaps are relatively small, therefore it is very difficult to control the size of the middle groove during the manufacture of the mold or the subsequent mass production. As a result, the blade will be loosened easily, and the shaving angle will be inconsistent. Furthermore, the gaps are evenly distributed, so that the blades disposed on the blade holder are arranged evenly (as shown in FIG. 6), and the first blade among the blades plays the role of taking the main shaving pressure while shaving, and the following blade just follows the first blade for shaving (as shown in FIG. 7), so that the following blade does not really plays its role, and the shaving efficiency will be lowered. In addition, the commercially available razors generally include a plurality of blades arranged parallel to each other, and a gap for guiding through of beard trimmings is formed between two blades, and each gap has the same width, so that such conventional razors have the drawbacks of low utilization rate of the blade, poor shaving effect, and uncomfortable use.

2. Summary of the Invention

Problem to be Solved

This disclosure intends to overcome the aforementioned drawbacks of the conventional razor head including its low shaving efficiency, poor shaving effect, and uncomfortable use.

Technical Solution

To achieve the aforementioned and other objectives, the present disclosure provides a matrix beard-trimmings guiding razor head comprising a blade holder and two or more groups of blade assemblies disposed on the blade holder and arranged parallel to each other, and each group of blades having two or more layers of blades arranged parallel to each other; an assembly interval being arranged between two adjacent blade assemblies, and the assembly interval having a width of 0.2~5 mm, and a layer interval being arranged between the blades of two adjacent layers in each group of blades, and the layer interval having a width of 0.15~1.5 mm.

In the aforementioned matrix beard-trimmings guiding razor head, the widths of the assembly intervals and the layer intervals are arranged equidistantly, sequentially from large to small, or sequentially from small to large.

In the aforementioned matrix beard-trimmings guiding razor head, the blade holder has a placing slot formed at the top thereof, and an inner stopper module and an outer stopper module disposed on both left and right sides of the placing slot respectively, and the inner stopper module includes a plurality of longitudinally arranged inner stoppers, and the outer stopper module includes a plurality of longitudinally arranged outer stoppers, and a first gap and a second gap are formed between any two adjacent inner stoppers and between any two adjacent outer stoppers respectively, and the first gap and second gap are staggered, and the blade is installed transversely into the placing slot, and both ends of the blade are plugged into the junction between the first gap and the second gap.

In the aforementioned matrix beard-trimmings guiding razor head, both ends of the first gap and both ends of the second gap are staggered.

The aforementioned matrix beard-trimmings guiding razor head further comprises a batten disposed on both left and right sides of the blade holder, and the batten presses at the top of the blade, and both ends of the batten are bent to clamp the blade holder.

In the aforementioned matrix beard-trimmings guiding razor head, the blade holder has two through holes formed on both left and right ends thereof, and both ends of the batten passing through the through holes are bent to clamp the blade holder.

In the aforementioned matrix beard-trimmings guiding razor head, the blade holder has a lubricating strip disposed at the top thereof.

In the aforementioned matrix beard-trimmings guiding razor head, the inner stopper and outer stopper have different widths.

In the aforementioned matrix beard-trimmings guiding razor head, the inner stopper and outer stopper have a chamfer disposed at the top thereof.

In the aforementioned matrix beard-trimmings guiding razor head, the interval between two adjacent blade assemblies is greater than the interval between two adjacent blades.

In the aforementioned matrix beard-trimmings guiding razor head, the blade has a straight-plate structure or a bent structure.

In the aforementioned matrix beard-trimmings guiding razor head, the blade has one end bent or both opposite ends bent, and the bent end forms a cutting edge.

In the aforementioned matrix beard-trimmings guiding razor head, both opposite ends of the blade are bent in the same direction or in opposite directions.

In the aforementioned matrix beard-trimmings guiding razor head, the blade includes a blade holder and a cutting edge; and an end or both opposite ends of the blade holder are bent, and the cutting edge is disposed at the bent end of the blade holder.

In the aforementioned matrix beard-trimmings guiding razor head, the cutting edge is soldered onto the bent end of the blade holder.

In the aforementioned matrix beard-trimmings guiding razor head, the cutting edge carries a center pad.

Beneficial Effects

The matrix beard-trimmings guiding razor head of this disclosure has the following advantages:

(1) The intervals of the blade assembly decreases gradually, and such blades arrangement has a major advantage of minimizing the skin stimulation produced by the blade for people with slow-growing beard while guaranteeing the shaving efficiency, so as to improve the comfortability of shaving and achieve a one-time thorough shaving of the remaining beard and stubble in a high-efficiency and comfortable manner.

(2) The intervals of the blade assembly decreasing gradually make the beard-trimmings guiding easier, and such gap is very suitable for the guiding of trimmings of long beard. This arrangement overcomes the difficulty of the guiding through of trimmings for long-beard users. Therefore, the razor head will be more sanitary and easier to clean and manage and has the effect of resisting the growth of bacteria.

(3) The gap between the blade assemblies falls within a range of 0.2 mm~5.0 mm, and the gap between the blades of each group of blades falls within a range of 0.15~1.5 mm to improve the beard-trimmings guiding effect.

(4) The razor head is convenient to install with a high precision and the blades of each group are fully utilized to provide a long service life and a good shaving effect of the blades.

(5) The razor head has a better face-attaching shaving effect and a higher efficiency. In the shaving method of the razor head, the lowest blade is the first blade in contact with a user's skin and thus has the highest utilization rate of shaving. The middle of the razor head definitely has an interval with a specific distance. In other words, there is more than one blade in contact with the user's skin for shaving, so that the shaving effect is more efficient.

(6) The service life of the blade is improved due to the better face-attaching effect, and the utilization rate of several layers of blades at the top is improved. As a result, the shaving pressure and worn-out of the conventional first blade are shared, and the service life of the blade is extended.

DESCRIPTION OF THE EMBODIMENTS

To understand the technical characteristics of this disclosure intuitively and comprehensively, exemplary embodiments are used and illustrated in referenced figures of the drawings. It is intended that the embodiments and figures disclosed herein are to be considered illustrative rather than restrictive.

Conventionally, the blades are arranged evenly on the blade holder, and the overall interval between the blades is too narrow, so that some beards cannot be inserted into the interval between the blades, but blocked by the blades. When shaving, the first blade among the blades plays a role of taking the shaving pressure, and the following blades follow the first blade for shaving. As a result, the following blades do not really play their role, and the shaving efficiency is lowered, and the beard-trimmings guiding effect is poor.

If the interval between the blades is too large, a good beard-trimmings guiding can be achieved and the shaving efficiency is improved, but the comfortability of using the blades will be reduced. Specifically, if the interval between the blades is too large, then the other blades will not be attached onto human skin closely. In other words, the cutting edge of the blade cannot be in contact with the root of the beard, and there is a possibility of sinking the human skin into the interval between the blades after the human skin is pressed. Therefore, the blade will be in contact with the skin too deep and will scratch the epidermis of the skin when shaving. Obviously, such use is very uncomfortable.

Figure 1:
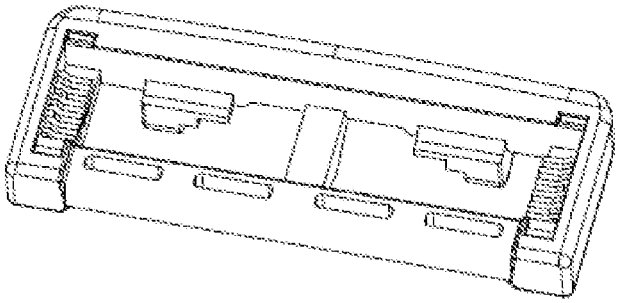
FIG. 1 is a perspective view of a first conventional blade holder.
Figure 2:
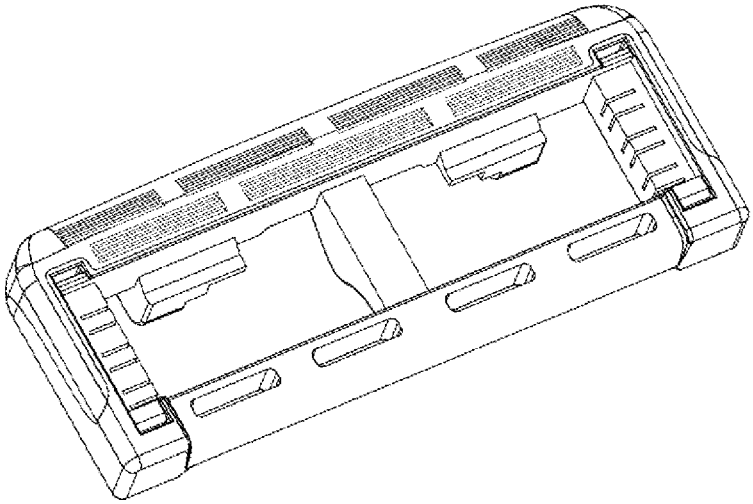
FIG. 2 is a perspective view of a second conventional blade holder.
Figure 3:
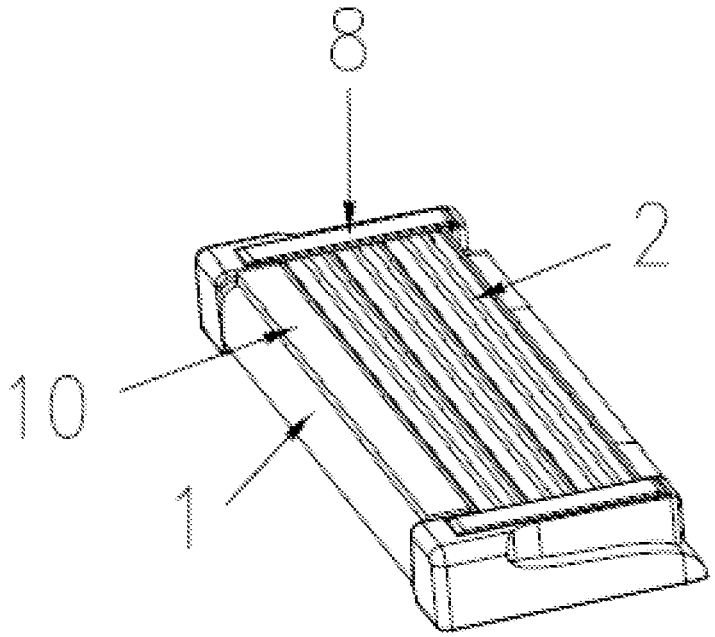
FIG. 3 is a perspective view of a matrix beard-trimmings guiding razor head of this disclosure.
Figure 4:
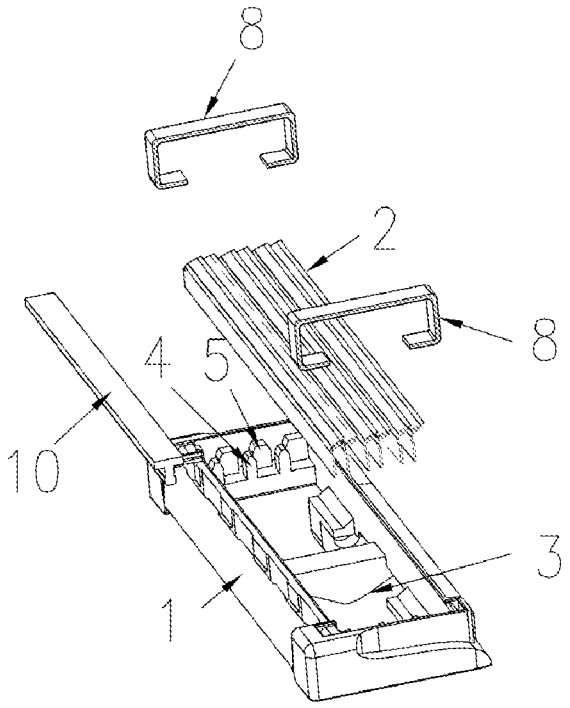
FIG. 4 is an exploded view of a matrix beard-trimmings guiding razor head of this disclosure.
Figure 5:
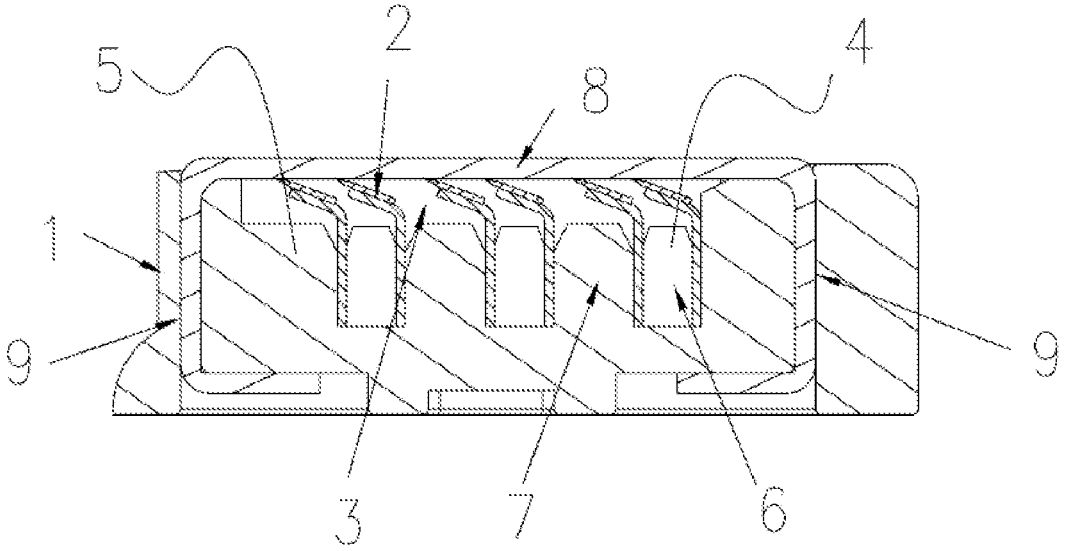
FIG. 5 is a schematic view of a matrix beard-trimmings guiding razor head of this disclosure.

To overcome the aforementioned drawbacks, this disclosure discloses a matrix beard-trimmings guiding razor head as shown in FIGS. 3~5, and the razor head comprises a blade holder 1 and two or more groups of blade assemblies 2 disposed on the blade holder 1 and arranged parallel to each other, and each group of blades has two or more layers of blades arranged parallel to each other; an assembly interval is arranged between two adjacent blade assemblies 2, and the assembly interval H has a width of 0.2~5 mm, and a layer interval is arranged between two adjacent blades in each group of blades, and the layer interval S has a width of 0.15~1.5 mm.

Figure 8:
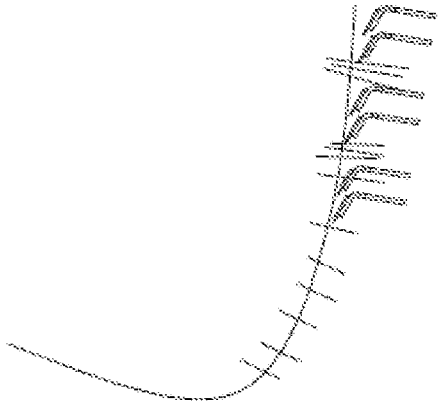
FIG. 8 is a schematic view showing the using status of a matrix beard-trimmings guiding razor head of this disclosure.

In general, the diameter of a beard is 0.1 mm. With reference to FIG. 8 for this disclosure, the assembly interval has a width of 0.2~5 mm, and the layer interval has a width of 0.15~1.5 mm. Obviously, the width of the assembly interval is greater than the width of the layer interval, so that a beard can be inserted into the assembly interval with the width of 0.2~5 mm, and the first blade in each group of blades can be attached closely to a user's face to share the shaving pressure of the first blade in the prior art. In addition, the layer interval has a width of 0.15~1.5 mm, so that the layer interval between the blades is small to prevent human skin from sinking into the layer interval and also prevent the epidermis of the user's skin from being scratched too much.

Therefore, the blades of this disclosure have the features of high utilization rate, good shaving effect, long service life, good beard-trimmings guiding, convenient rinsing, and sanitary use. Since the blade do not scratch the epidermis of the user's skin too much, the use is more comfortable.

Figure 25:
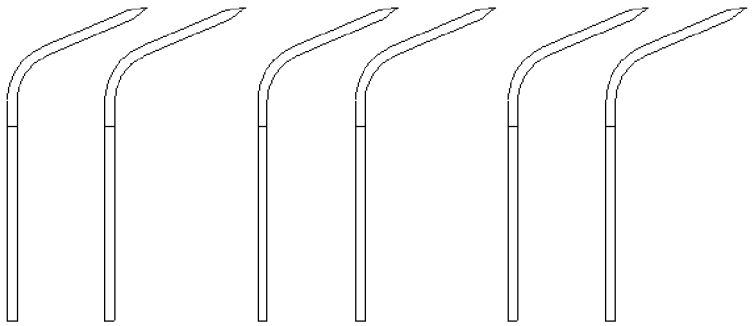
FIG. 25 is a schematic view showing the arrangement of blades in accordance with a seventeenth embodiment of this disclosure.

In FIG. 5, the blade is comprises of a bent blade holder and a cutting edge, and the cutting edge is disposed at the bent end of the blade holder, and the blades as shown in FIG. 25 and the blades as shown in FIG. 5 are substantially the same, except that the blades as shown in FIG. 25 are of a one-piece structure, which is a structure from by bending the blades.

A matrix beard-trimmings guiding razor head comprises a blade holder 1, six blades disposed on the blade holder 1, and a batten 8 disposed on both left and right sides of the blade holder 1, characterized in that a placing slot 3 is formed at the top of the blade holder 1, and an inner stopper module 4 and an outer stopper module 5 are disposed on both left and right sides of the placing slot 3 respectively, and each inner stopper module 4 includes three longitudinally arranged inner stoppers 6, and each outer stopper module 5 includes four longitudinally arranged outer stoppers 7, wherein a first gap and a second gap are formed between any two adjacent inner stoppers 6 and between any two outer stoppers 7 respectively, and the first gap and the second gap are staggered; specifically, both ends of the first gap and both ends of the second gap are staggered. The blade is transversally installed into the placing slot 3, and both ends of the blade are plugged into the junction between the first gap and the second gap. Two through holes 9 are formed on both left and right sides of the blade holder 1 and disposed on both front and rear sides of the blade holder 1 respectively, and both ends of the batten 8 are passed through the through holes 8 and bent to clamp the blade holder 1. With this structure, the blade can be plugged downwardly in the direction towards the interval during installation, so that one of the front side and back side of the blade 2 is in contact with the inner stopper 6 and the outer stopper 7 to achieve the fixation. Since the inner stopper 6 and the outer stopper 7 are staggered, therefore both sides of the interval are not necessary to be on the same projecting plane, and the size of the mold can be controlled more precisely in the manufacture of the mold. Even if there is a slight deformation of the blade holder manufactured by injection molding, the installation precision of the blades will not be affected. Therefore, the difficulty and cost of manufacturing the mold can be reduced significantly, and such arrangement also facilitates the maintenance and repair of the mold.

The blade holder 1 has a lubricating strip 10 disposed at the top of the blade holder 1 and provided for reducing the skin stimulation caused by the blade, lubricating the user's face, and improving the comfort of shaving.

The width of the inner stopper 6 and the width of the outer stopper 7 are different. In the figures, the width of the inner stopper 6 is smaller than the width of the outer stopper 7, so that the blades disposed on both sides of the inner stopper 6 are of the same group, and there are three groups. During shaving, each group of blades can be utilized fully to improve the service life of the blades and achieve a good shaving effect.

In this disclosure, the intervals between the blade assemblies 2 have the widths arranged sequentially from large to small or from small to large.

Figure 9:
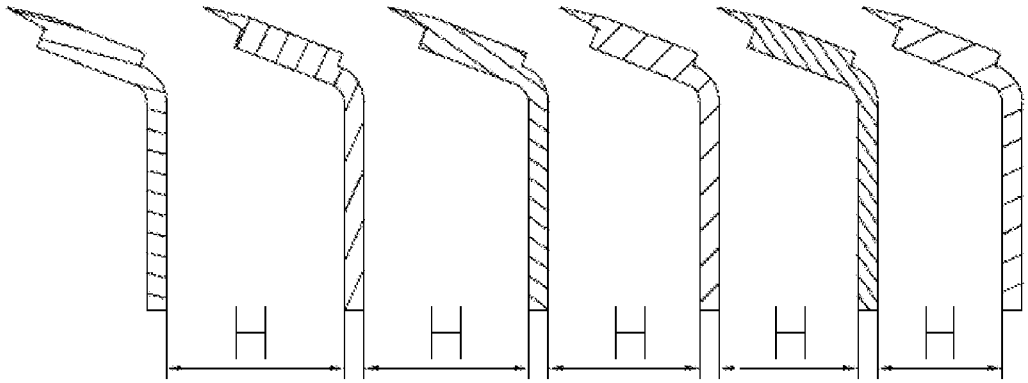
FIG. 9 is a schematic view showing the arrangement of blades in accordance with a first embodiment of this disclosure.

With reference to FIG. 9 for Embodiment 1, each group of blade assemblies 1 has only one blade, and there are six groups, and the gap between the blade assemblies 2 changes gradually from large to small.

The major advantage of such blades arrangement aims at the users with fast growing beard and guarantees a good shaving efficiency, a low skin stimulation caused by the blade, and an acceptable comfort of shaving. During shaving, the gaps between the first blade, second blade, and third blade are relatively large, so that the beard on the skin is touched more easily during the shaving, and the fine and dense beards on the skin can be cut and removed in the first few strokes, and then the blades of the fourth, fifth, and sixth layers guarantees the comfort of shaving and protect the skin since the gap between the blades has become smaller, and the angle of the cutting edge for shaving the user's face becomes much smaller. As a result, the remaining beard and stubble can be shaved, and a one-time thorough shaving in a highly efficient and comfortable manner. In addition, the gaps between the blades are arranged from large to small facilitate the guiding through of beard trimmings, since the first three strokes have already cut and removed most beards on the skin, and such gaps facilitate the guiding through of trimmings of long beards and thus overcome the difficulty of guiding through the long beard trimmings in the prior art. The razor head has the features of providing better sanitation, easier management, and good resistance to the growth of bacteria.

Figure 10:
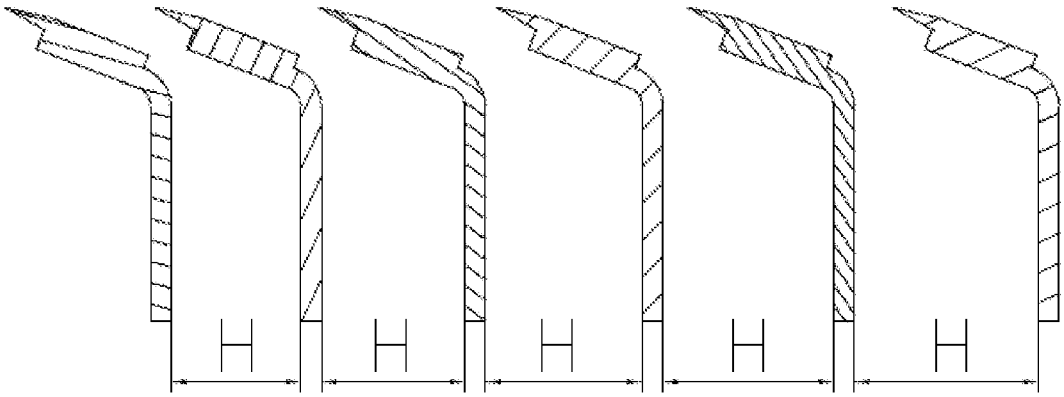
FIG. 10 is a schematic view showing the arrangement of blades in accordance with a second embodiment of this disclosure.

With reference to FIG. 10 for Embodiment 2, each group of blade assemblies 1 just has one blade, and there are six groups, and the gaps between the blade assemblies are arranged from small to large gradually.

The gaps between the blade assembly arranged from small to large mainly aim at the users with fast growth of beard, and this arrangement fits them better. In the blades arrangement, the gaps of six layers of blades are arranged from small to large, and the gap of the first three layers of blades are not large, so that the angle of the cutting edge for shaving the user's face is not very large, and thus providing a comfortable shaving to users and a better face-attaching effect. The gaps of the following fourth, fifth, and sixth layers become larger gradually, so that the angle of the cutting edge of the blades becomes larger accordingly, and the remaining beard and stubble, efficiency can be shaved better and faster. 1. Such blades provide a better shaving effect to users with dense and hard beard. 2. The increased gap provides a better beard-trimmings guiding effect, and such arrangement fits users with various different beards and has a broader scope of applicability. It provides a more convenient beard-trimmings guiding for users with long beard and has the effect of protecting the razor head better and resisting the growth of bacteria.

Figure 11:
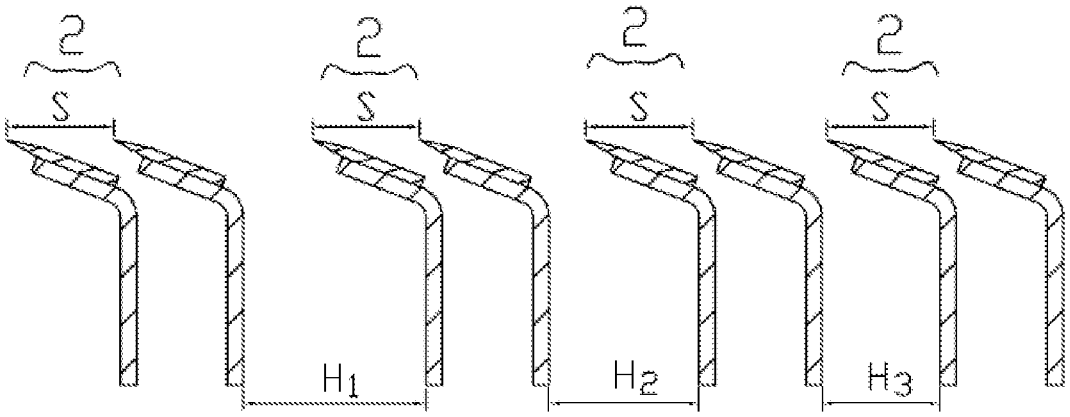
FIG. 11 is a schematic view showing the arrangement of blades in accordance with a third embodiment of this disclosure (wherein the layer interval width s remains unchanged, and the assembly interval width H is decreasing)
Figure 26:
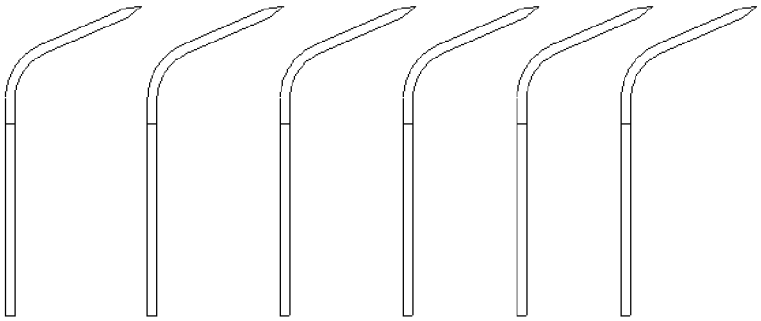
FIG. 26 is a schematic view showing the arrangement of blades in accordance with an eighteenth embodiment of this disclosure.

With reference to FIGS. 11 and 26 for Embodiments 3 and 18 respectively, each group of blade assemblies 1 has two blades, and there are four groups, and the specific quantity depends on actual needs. In the figures, the gaps H between the blade assemblies 2 are arranged from large to small gradually, and the distance S between the blades in each group of blade assemblies remains unchanged, and its effect is the same as that of Embodiment 1. Further, an assembly interval is designed to improve the comfort of using the blade.

The major advantage of such blades arrangement aims at the users with slow growing beard and guarantees a good shaving efficiency, a low skin stimulation caused by the blade, and an acceptable comfort of shaving. During shaving, the gaps between the first blade, second blade, and third blade are relatively large, so that the beard on the skin is touched more easily during the shaving, and the fine and dense beards on the skin can be cut and removed in the first few strokes, and then the blades of the following fourth, fifth and sixth layers guarantees the comfort of shaving and protect the skin, since the gap between the blades has become smaller, and the angle of the cutting edge for shaving the user's face becomes smaller, and the angle of the cutting edge for shaving the user's face is reduced significantly to guarantee the comfort of use ability. As a result, the remaining beard and stubble can be shaved, and a one-time thorough shaving in a highly efficient and comfortable manner. In addition, the gaps between the blades are arranged from large to small facilitate the guiding through of beard trimmings, since the first three strokes have already cut and removed most long beards on the skin, and such gaps facilitate the guiding through of trimmings of long beards and thus overcome the difficulty of guiding through the long beard trimmings in the prior art. The razor head has the features of providing better sanitation, easier management, and good resistance to the growth of bacteria.

Figure 12:
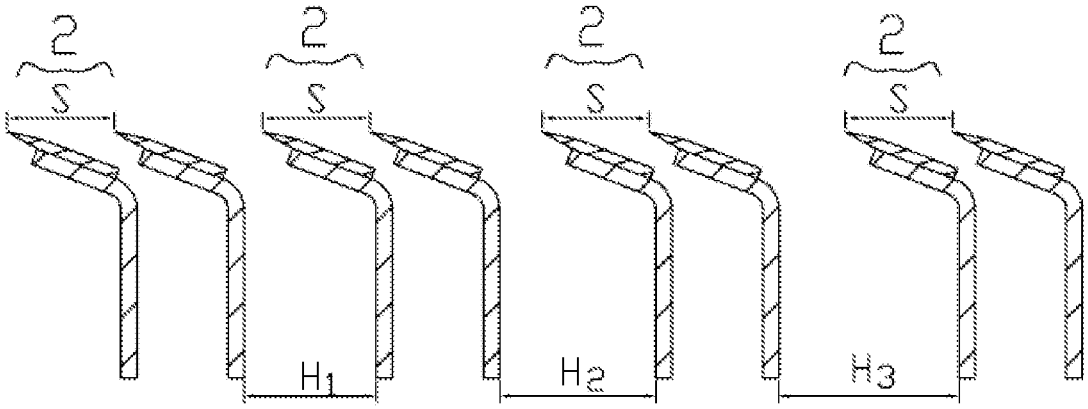
FIG. 12 is a schematic view showing the arrangement of blades in accordance with a fourth embodiment of this disclosure (wherein the layer interval width s remains unchanged, and the assembly interval widths H are arranged from small to large)
Figure 27:
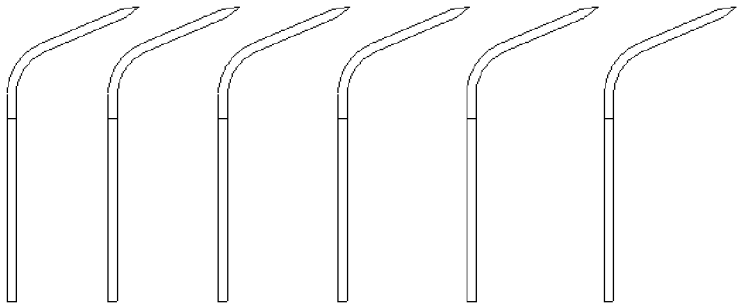
FIG. 27 is a schematic view showing the arrangement of blades in accordance with a nineteenth embodiment of this disclosure.

With reference to FIGS. 12 and 27 for Embodiments 4 and 19 respectively, each group of blade assemblies 1 has two blades, and there are four groups, and the specific quantity depends on actual needs. In the figures, the intervals H between the blade assemblies 2 are arranged from small to large gradually, and the distance between the blades of each group of blade assemblies remains unchanged, and its effect is the same as that of Embodiment 2.

The gaps of such blade assembles are arranged from small to large gradually. The major advantage of such blades arrangement aims at the users with fast growing beard and this arrangement fits them better. In the blades arrangement, the gaps of six layers of blades are arranged from small to large, and the gaps of the first three layers of blades are not large, and the angle of the cutting edge for shaving the user's face is not too large to guarantee a better comfort of shaving and face-attaching effect. The gaps of the following fourth, fifth and sixth layers become larger gradually, so that the angle of the cutting edge of the blades for shaving becomes larger accordingly to achieve the effects of a better shaving effect of the remaining beard and stubble and a higher efficiency. 1. Such blade provides a better shaving effect for users with dense and hard beard. 2. The increased gap provides a better beard-trimmings guiding effect, and such arrangement fits users with various different beards and has a broader scope of applicability. It provides a more convenient beard-trimmings guiding for users with long beard and has the effect of protecting the razor head better and resisting the growth of bacteria.

Figure 6:
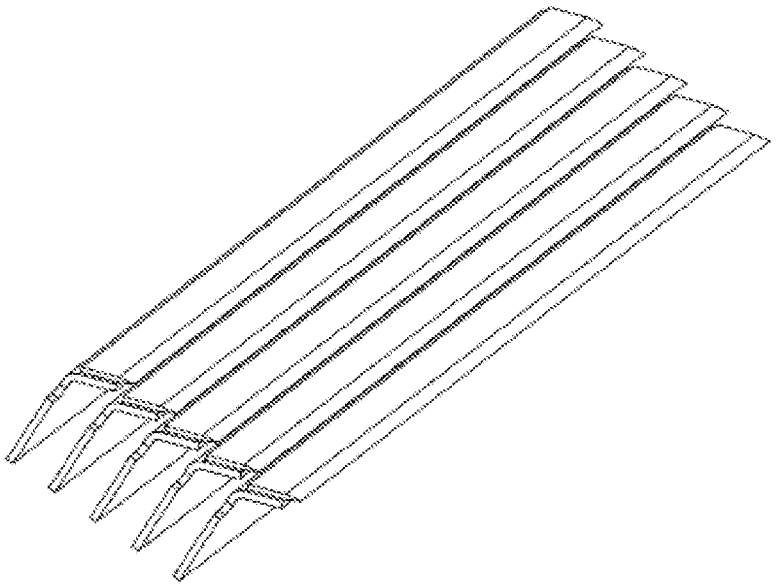
FIG. 6 is a schematic view showing the arrangement of blades of a prior art.
Figure 7:
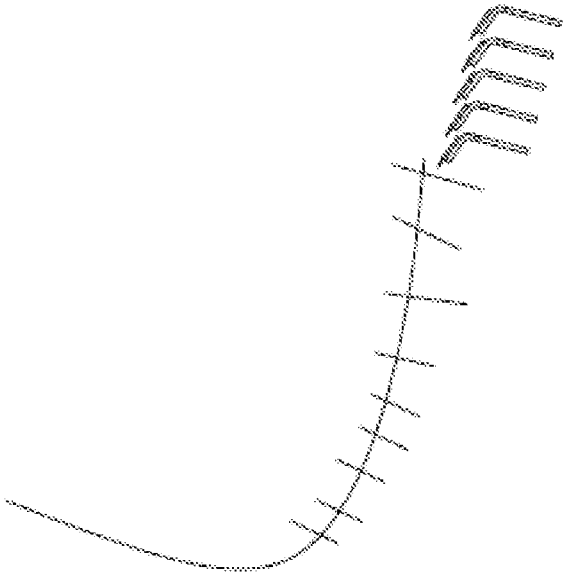
FIG. 7 is a schematic view showing the using status of the blades of a prior art.

Besides the gaps arranged from small to large or from large to small sequentially as described in the aforementioned embodiments, the arrangement may be an equidistant arrangement. In FIGS. 6 and 25, each group of blade assemblies has two blades, and there are three groups, and the specific quantity depends on actual needs, wherein each group is equidistantly arranged.

Figure 31:
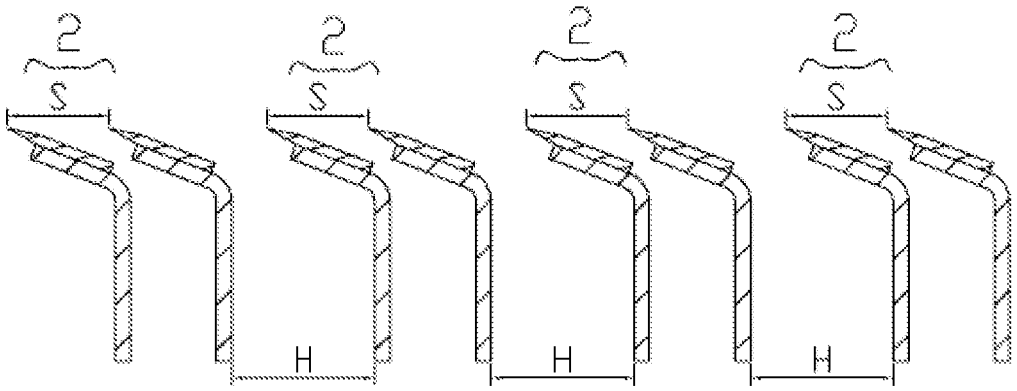
FIG. 31 is a schematic view showing the arrangement of blades in accordance with a twenty-third embodiment of this disclosure (wherein the layer interval width s remains unchanged, and the assembly interval width H remains unchanged)

With reference to FIG. 31 for Embodiment 23, each group of blade assemblies has two blades, and there are four groups, and the widths of the layer intervals s are the same, and the widths of the assembly intervals H are the same, and this structure allows the first blade of each group of blades to attach to the user's face closely, so as to shave the beards simultaneously and share the shaving pressure of the conventional razor head having only one blade. Therefore, this embodiment can achieve the effects of improving the utilization rate and shaving effect of the blades and extending the service life. In addition, the interval between two adjacent blades is relatively large, so that the guiding through of beard trimmings and rinsing is convenient, and the use is sanitary.

The aforementioned embodiments are applied as the technical solution for the single blade, and the following embodiments provides blades with both blade surface bent in the same direction or in opposite directions, or blades with a straight single-sided plate having an interval of a central pad to achieve the same technical effect of this disclosure.

Figure 13:
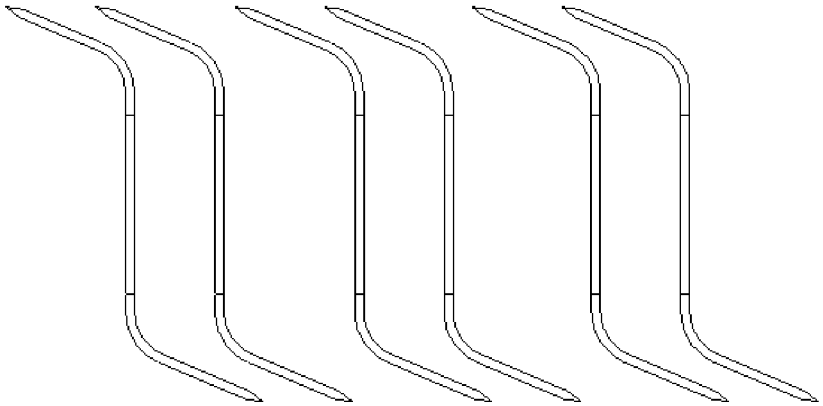
FIG. 13 is a schematic view showing the arrangement of blades in accordance with a fifth embodiment of this disclosure.
Figure 14:
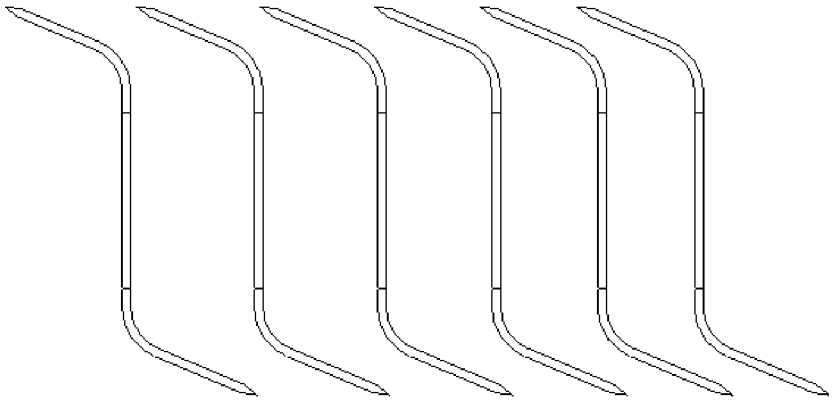
FIG. 14 is a schematic view showing the arrangement of blades in accordance with a sixth embodiment of this disclosure.
Figure 15:
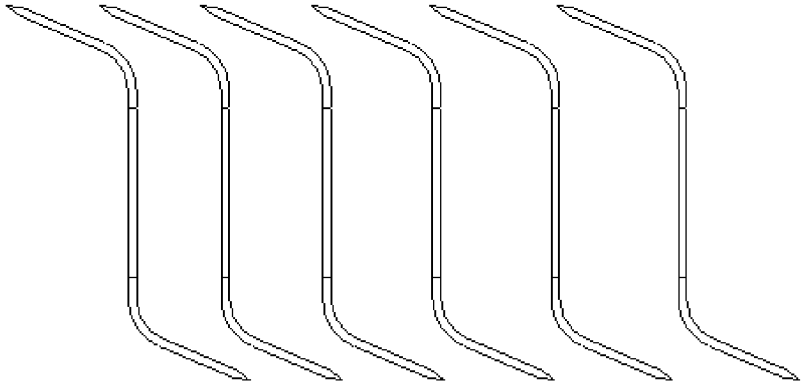
FIG. 15 is a schematic view showing the arrangement of blades in accordance with a seventh embodiment of this disclosure.
Figure 16:
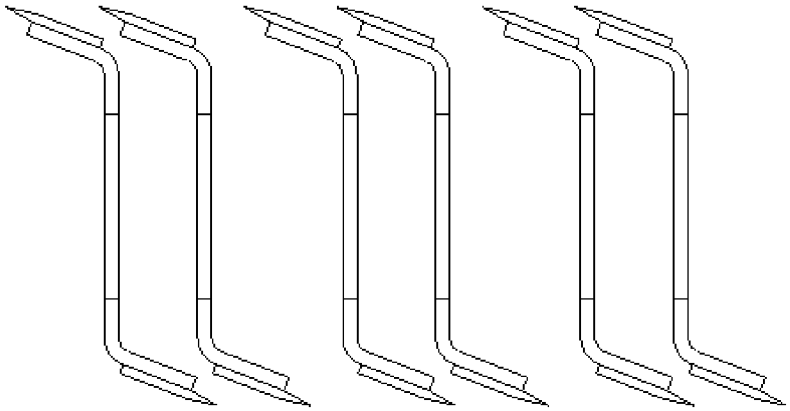
FIG. 16 is a schematic view showing the arrangement of blades in accordance with an eighth embodiment of this disclosure.
Figure 17:
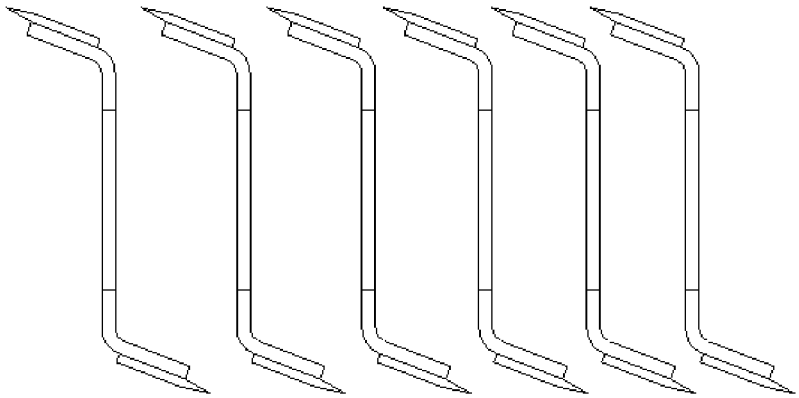
FIG. 17 is a schematic view showing the arrangement of blades in accordance with a ninth embodiment of this disclosure.
Figure 18:
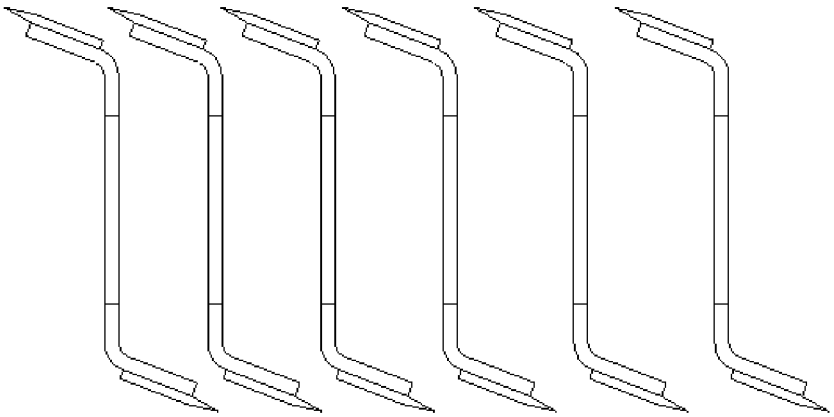
FIG. 18 is a schematic view showing the arrangement of blades in accordance with a tenth embodiment of this disclosure.

With reference to FIGS. 13~18 for the blades with both ends bent in opposite directions, the cutting edges at both ends of the blade are specifically bent to the left and to the right respectively, and the single blade as shown in FIGS. 13~15 is of a one-piece bent structure, and the single blade as shown in FIGS. 16~18 is of a spliced structure, and both ends of the blade holder are bent to the left and to the right respectively, and the cutting edge is installed to the bent end of the blade holder by welding, and both ends of the cutting edge are configured to be opposite to each other.

Figure 19:
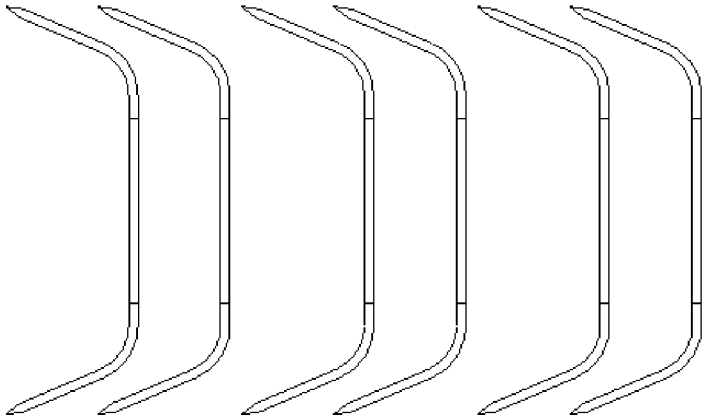
FIG. 19 is a schematic view showing the arrangement of blades in accordance with an eleventh embodiment of this disclosure.
Figure 20:
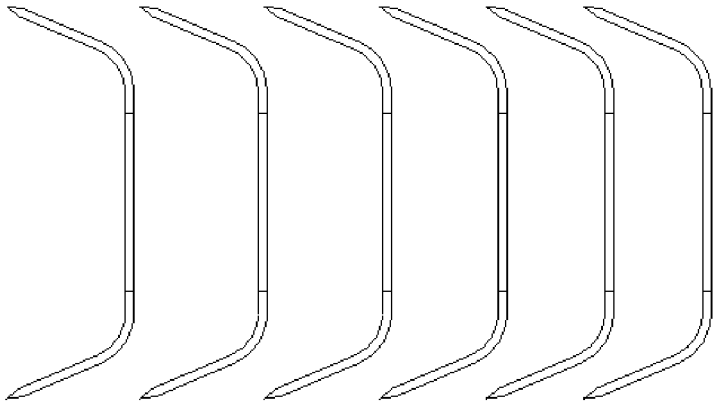
FIG. 20 is a schematic view showing the arrangement of blades in accordance with a twelfth embodiment of this disclosure.
Figure 21:
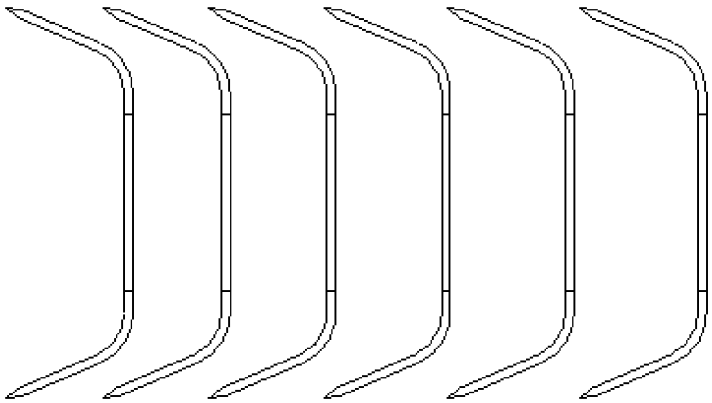
FIG. 21 is a schematic view showing the arrangement of blades in accordance with a thirteenth embodiment of this disclosure.
Figure 22:
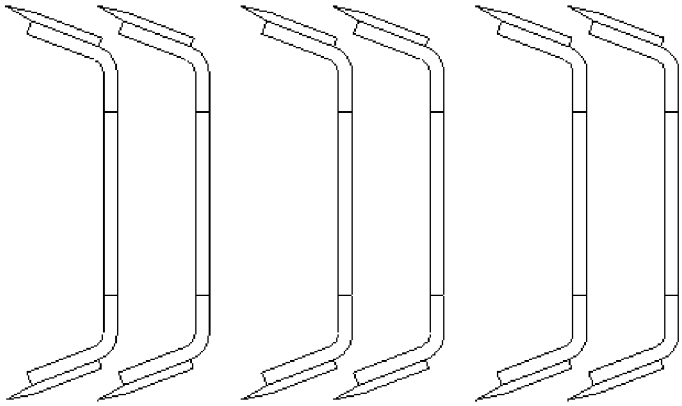
FIG. 22 is a schematic view showing the arrangement of blades in accordance with a fourteenth embodiment of this disclosure.
Figure 23:
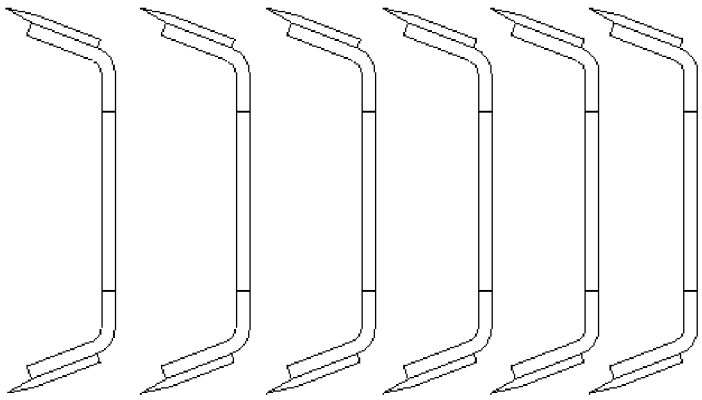
FIG. 23 is a schematic view showing the arrangement of blades in accordance with a fifteenth embodiment of this disclosure.
Figure 24:
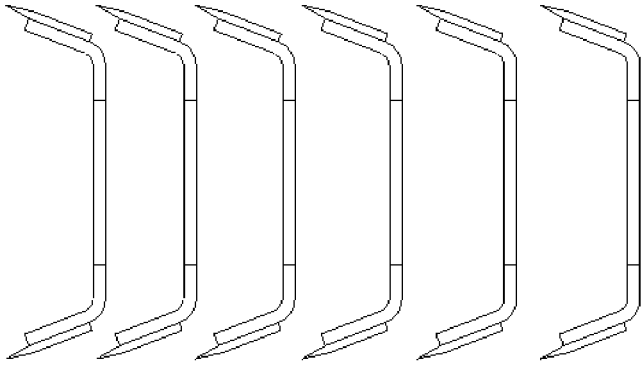
FIG. 24 is a schematic view showing the arrangement of blades in accordance with a sixteenth embodiment of this disclosure.

With reference to FIGS. 19~24 for a blade with both ends bent in the same direction, the cutting edges at both ends of the blade are specifically bent to the left or the right, and the single blade as shown in FIGS. 19~21 is of a one-piece bent structure, and the single blade as shown in FIGS. 22~24 is of a spliced structure comprising a blade holder and a cutting edge, wherein both ends of the blade holder are bent to the left or to the right at the same time, and the cutting edge is installed to the bent end by welding.

Figure 28:
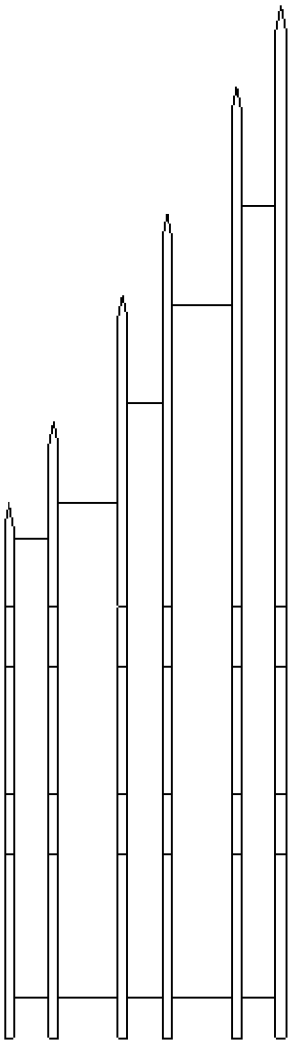
FIG. 28 is a schematic view showing the arrangement of blades in accordance with a twentieth embodiment of this disclosure.
Figure 29:
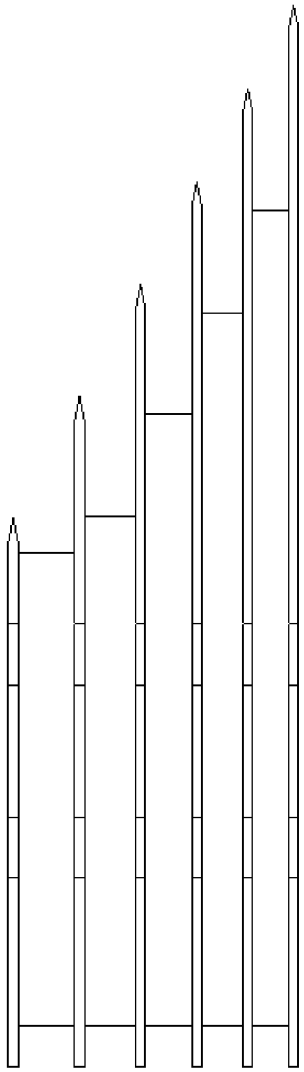
FIG. 29 is a schematic view showing the arrangement of blades in accordance with a twenty-first embodiment of this disclosure.
Figure 30:
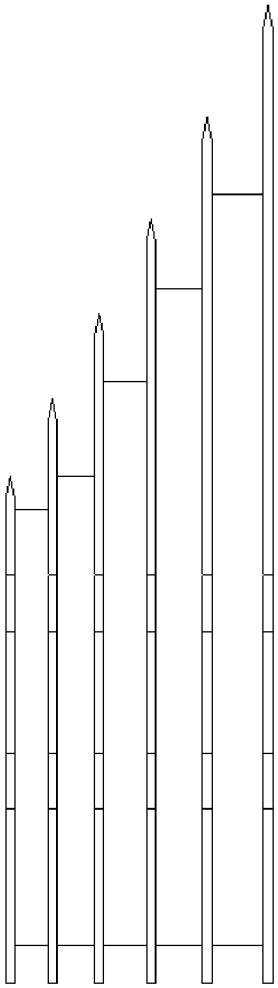
FIG. 30 is a schematic view showing the arrangement of blades in accordance with a twenty-second embodiment of this disclosure.

With reference to FIGS. 28~30 for a non-beard-trimmings guiding blade which is formed by a straight-plate blade with a cutting edge disposed at an end of the blade and a central pad disposed at the middle and having a different thickness, wherein the central pad is disposed between the blades to limit the interval between the blades and the angle, and such structure fits three kinds of matrix arrangement, and the blades may be arranged from wide to narrow, from narrow to wide, or arranged equidistantly.

In Embodiments 5, 8, 11, 14 and 20 as shown in FIGS. 13, 16, 19, 22 and 28 respectively, the blade assemblies are arranged equidistantly. In the figures, each blade assembly has two blades, and there are a total three groups, and each group has the same interval with one another. The specific quantity of blades in each group and the specific quantity of groups of blades depend on actual requirements, and this structure allows the first blade of each group of blades to be attached to a user's face to shave the user's beard and share the shaving pressure of only one blade of the prior art, so as to provide a high utilization rate of the blades, improve the shaving effect, and extend the service life. In addition, the interval between two adjacent blades is large, so as to facilitate the guiding through of beard trimmings and rinsing and provide a sanitary use.

With reference to FIGS. 14, 17, 20, 23 and 29 for Embodiments 6, 9, 12, 15 and 21 respectively, the blade assemblies are arranged sequentially from large to small, and each group of blade assemblies has one blade, and there are six groups, and the specific quantity depends on actual needs. The interval of each group is arranged from large to small and its effect is the same as that of Embodiment 1. These embodiments aim at the users with relatively slow growing beard and guarantee a high shaving efficiency, a low skin stimulation caused by the blade, and a comfortable shaving. Such gaps facilitate the guiding through of trimmings of long beards and thus overcome the difficulty of leaking the long beards in the prior art. The razor head has the features of providing better sanitation, easier management, and good resistance to the growth of bacteria.

With reference to FIGS. 15, 18, 21, 24 and 30 for Embodiments 7, 10, 13, 16 and 22 respectively, the blade assemblies are arranged from small to large, or each group of blade assemblies has one blade, and there are fix groups, and the specific quantity depends on actual needs, and the interval of each group is arranged from small to large and its effect is the same as that of Embodiment 2. This blade arrangement aims at the users with relatively fast growing beard, and such arrangement fits them better. The increased gap provides a better beard-trimmings guiding effect and thus the razor head fits users with different beards, and the scope of applicability is broadened. This razor head has the effects of facilitating the guiding through of trimmings of long beard, protecting the razor head better, and resisting the growth of bacteria.

Figure 32:
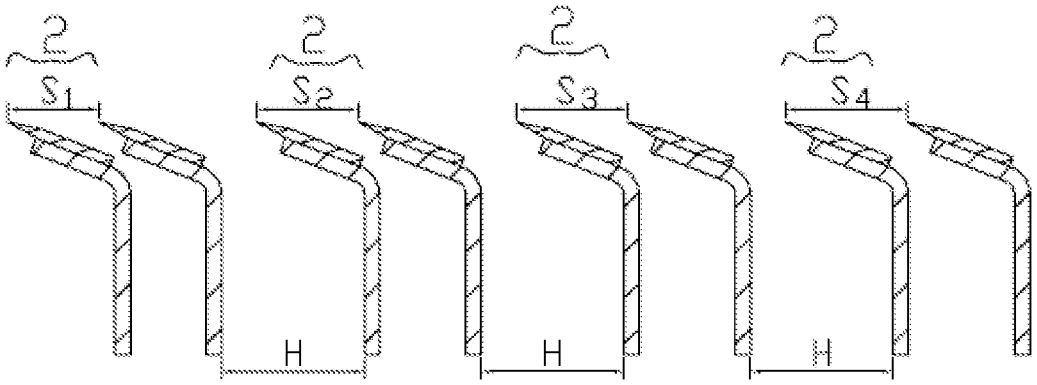
FIG. 32 is a schematic view showing the arrangement of blades in accordance with a twenty-fourth embodiment of this disclosure (wherein the layer interval widths s are arranged from small to large, and the assembly interval width H remains unchanged)

With reference to FIG. 32 for Embodiment 24, there are four groups of blade assemblies, and each group of blade assemblies 2 has two layers of blades, wherein the assembly interval H remains unchanged, and the layer interval S is designed from small to large, so that its effect is the same as that of Embodiment 2.

Figure 33:
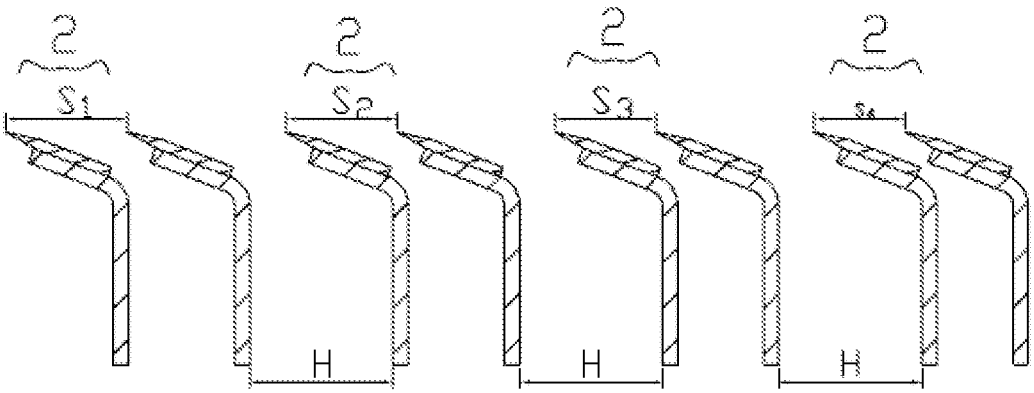
FIG. 33 is a schematic view showing the arrangement of blades in accordance with a twenty-fifth embodiment of this disclosure (wherein the layer interval widths s are arranged from small to large and the assembly interval widths are arranged from small to large)

With reference to FIG. 33 for Embodiment 25, there are four groups of blade assemblies, and each group of blade assemblies 2 has two layers of blades, wherein the assembly interval H remains unchanged, and the layer interval S is designed from large to small, so that its effect is the same as Embodiment 1.

Figure 34:
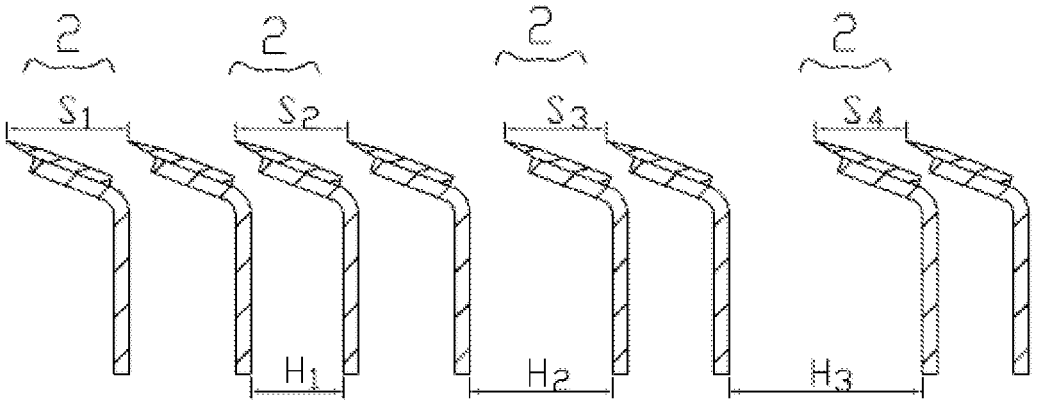
FIG. 34 is a schematic view showing the arrangement of blades in accordance with a twenty-sixth embodiment of this disclosure (wherein the layer interval widths s are arranged from large to small, and the assembly interval widths H are arranged from small to large)

With reference to FIG. 34 for Embodiment 26, there are four groups of blade assemblies, and each group of blade assemblies 2 has two layers of blades, wherein the assembly interval H and the layer interval S are both designed from small to large.

Figure 35:
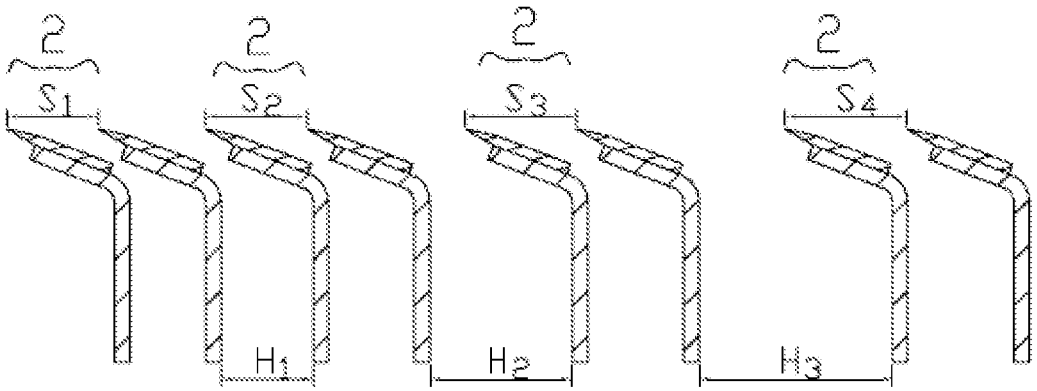
FIG. 35 is a schematic view showing the arrangement of blades in accordance with a twenty-seventh embodiment of this disclosure (wherein the layer interval widths s are arranged from large to small, and the assembly interval widths H are arranged from small to large)

With reference to FIG. 35 for Embodiment 27, there are four groups of blade assemblies, and each group of blade assemblies 2 has two layers of blades, wherein the assembly interval H is designed from small to large, and the layer interval S is designed from large to small.

Figure 36:
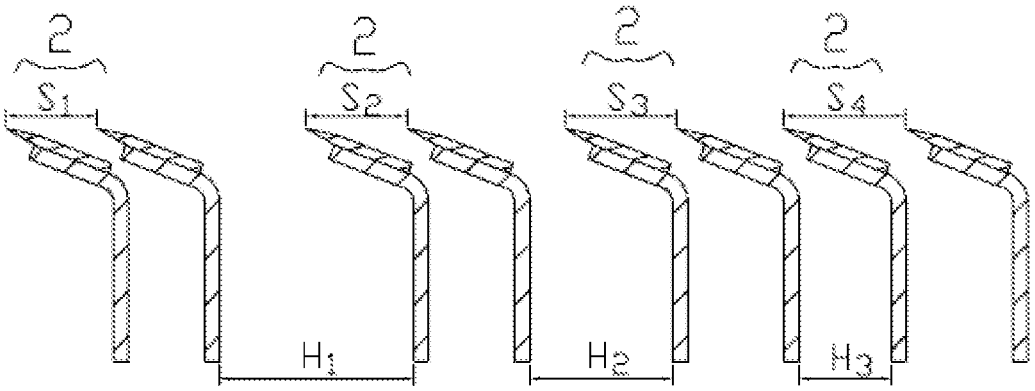
FIG. 36 is a schematic view showing the arrangement of blades in accordance with a twenty-eighth embodiment of this disclosure (wherein the layer interval widths s are arranged from small to large, and the assembly interval widths Hs are arranged from large to small)

With reference to FIG. 36 for Embodiment 28, there are four groups of blade assemblies, and each group of blade assemblies 2 has two layers of blades, wherein the assembly interval H is designed form large to small, and the layer interval S is designed from small to large.

Figure 37:
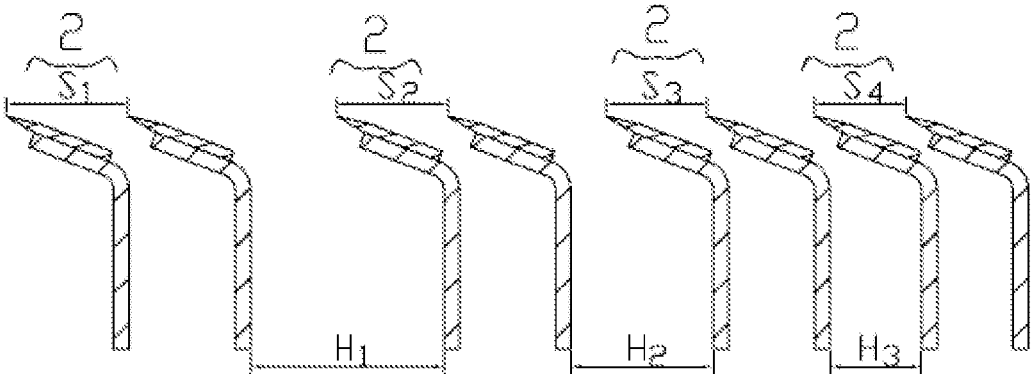
FIG. 37 is a schematic view showing the arrangement of blades in accordance with a twenty-ninth embodiment of this disclosure (wherein the layer interval widths s are arranged from large to small, and the assembly interval widths Hs are arranged from large to small).

With reference to FIG. 37 for Embodiment 29, there are four groups of blade assemblies, and each group of blade assemblies 2 has two layers of blades, wherein the assembly interval H and the layer interval S are both designed from large to small.

While this disclosure has been described by means of specific embodiments, numerous modifications and variations could be made thereto by those skilled in the art without departing from the scope and spirit of the invention set forth in the claims.

The invention claimed is:

1. A matrix beard-trimmings guiding razor head, comprising a blade holder (1) and four groups of blade assemblies (2) disposed on the blade holder (1) and arranged parallel to each other, the four groups group of blade assemblies (2) each having two layers of blades arranged parallel to each other; an assembly interval being arranged between two adjacent blade assemblies (2), and the assembly interval having a width of 0.2~5 mm, and assembly intervals of the four groups of blade assemblies (2) being designed from large to small, and a layer interval being arranged between the two layers of blades in each group of blade assemblies (2), and the layer interval having a width of 0.15~1.5 mm and layer intervals of the four groups of blades assemblies (2) being designed from small to large.

2. The matrix beard-trimmings guiding razor head of claim 1, wherein the interval between two adjacent blade assemblies is greater than the interval between two adjacent blades.

3. The matrix beard-trimmings guiding razor head of claim 1, wherein the blade has a straight-plate structure or a bent structure.

4. The matrix beard-trimmings guiding razor head of claim 2, wherein the blade has one end bent or both opposite ends bent, and the bent end forms a cutting edge.

5. The matrix beard-trimmings guiding razor head of claim 2, wherein both opposite ends of the blade are bent in the same direction or in opposite directions.

6. The matrix beard-trimmings guiding razor head of claim 5, wherein the blade includes a blade holder and a cutting edge; and an end or both opposite ends of the blade holder are bent, and the cutting edge is disposed at the bent end of the blade holder, wherein the cutting edge is soldered onto the bent end of the blade holder.

* * * * *